United States Patent [19]

Reprogle et al.

[11] 4,393,537

[45] Jul. 19, 1983

[54] POWER BROOM WITH AUGER AND VACUUM DEBRIS CONVEYOR

[75] Inventors: Layton J. Reprogle; Truman B. Reprogle, both of St. Louis County, Mo.

[73] Assignee: All Temp Engineering Inc., St. Louis, Mo.

[21] Appl. No.: 282,812

[22] Filed: Jul. 13, 1981

[51] Int. Cl.[3] ..... E01H 1/04

[52] U.S. Cl. ..... 15/348; 15/79 A; 15/83; 15/340; 15/349; 15/373

[58] Field of Search ..... 15/78, 79 A, 83, 340, 15/348, 349, 372, 373

[56] References Cited

U.S. PATENT DOCUMENTS

| | | | |
|---|---|---|---|
| 959,380 | 5/1910 | Otis | 15/340 X |
| 1,255,519 | 2/1918 | Ellis | 15/340 X |
| 2,298,054 | 10/1942 | Howell | 15/83 X |
| 3,704,477 | 12/1972 | Bonnis | 15/79 A |
| 4,120,311 | 10/1978 | Dunham et al. | 15/83 X |

*Primary Examiner*—Chris K. Moore

*Attorney, Agent, or Firm*—Polster, Polster & Lucchesi

[57] ABSTRACT

A power broom with a transverse auger and vacuum debris conveying system especially well-suited for removing gravel or other debris from a flat, built-up roof or the like, and for conveying the loosened debris from the roof. The power broom includes a horizontal, rotary brush for dislodging gravel, dirt, and other debris from the roof and for propelling the debris within an enclosure substantially surrounding the rotary brush toward the auger which in turn positively conveys the dense gravel particles and other debris toward a vacuum pick up point within the brush enclosure where high velocity air from a vacuum source readily picks up and conveys the dense gravel particles from the power broom to a collector via a vacuum hose. The power broom is further provided with a handle assembly which is selectively operable to simultaneously disengage the power drive propulsion system of the broom and to raise the rotary brush clear of the roof.

8 Claims, 9 Drawing Figures

FIG. 4.
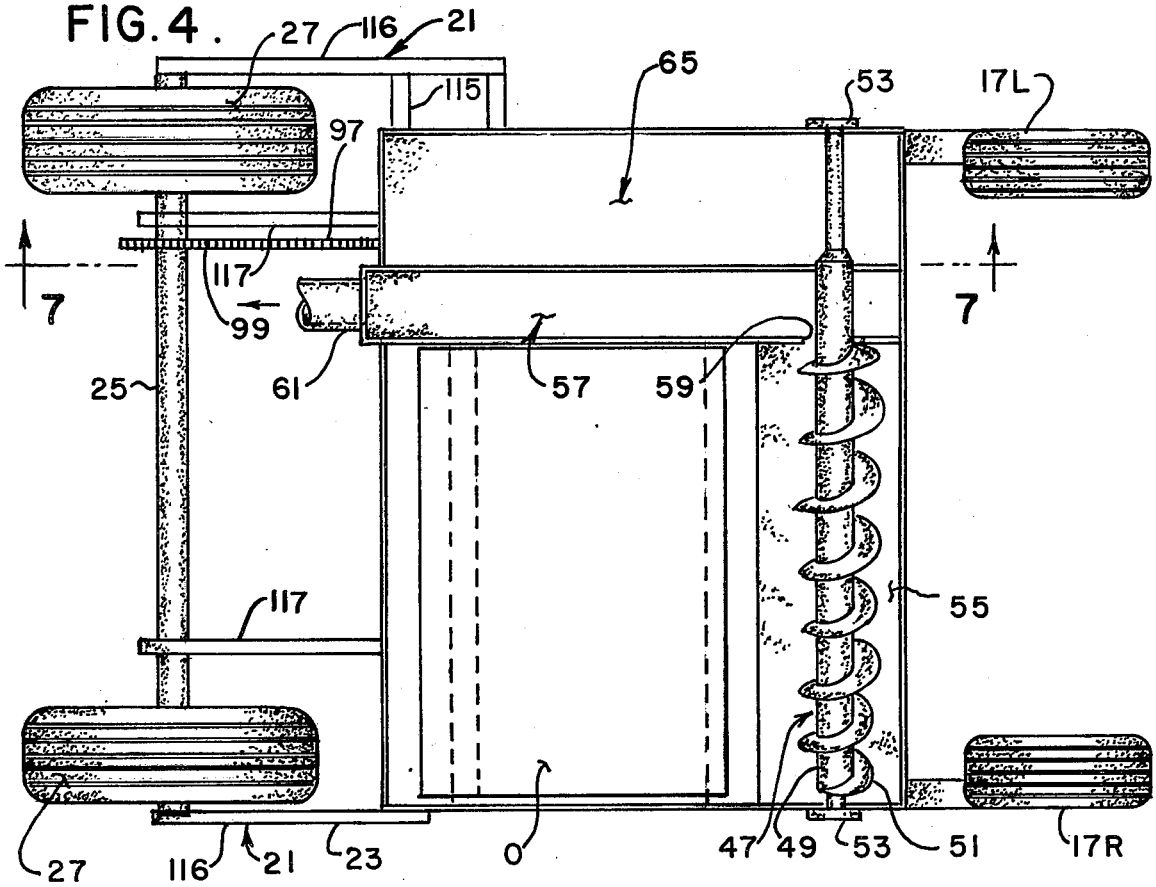
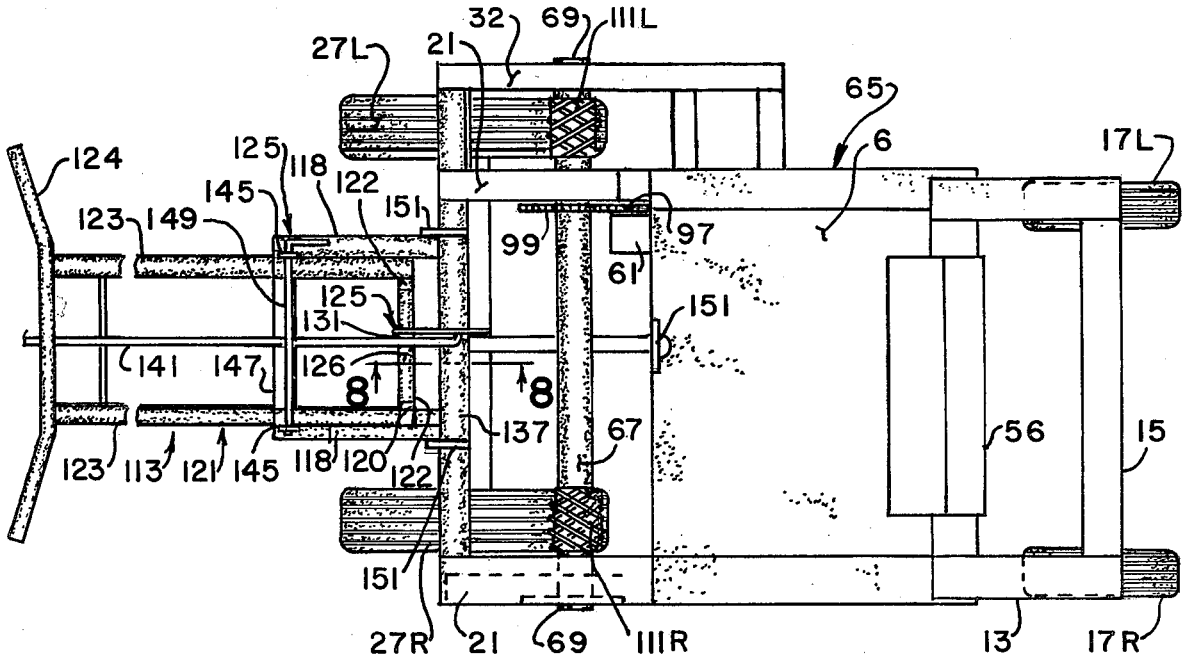
FIG. 5.

FIG. 6.
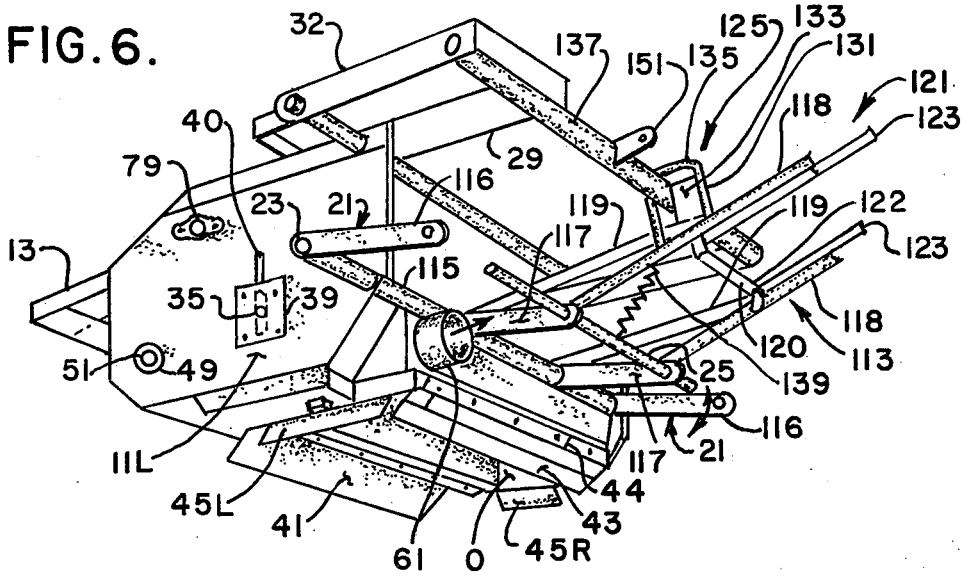
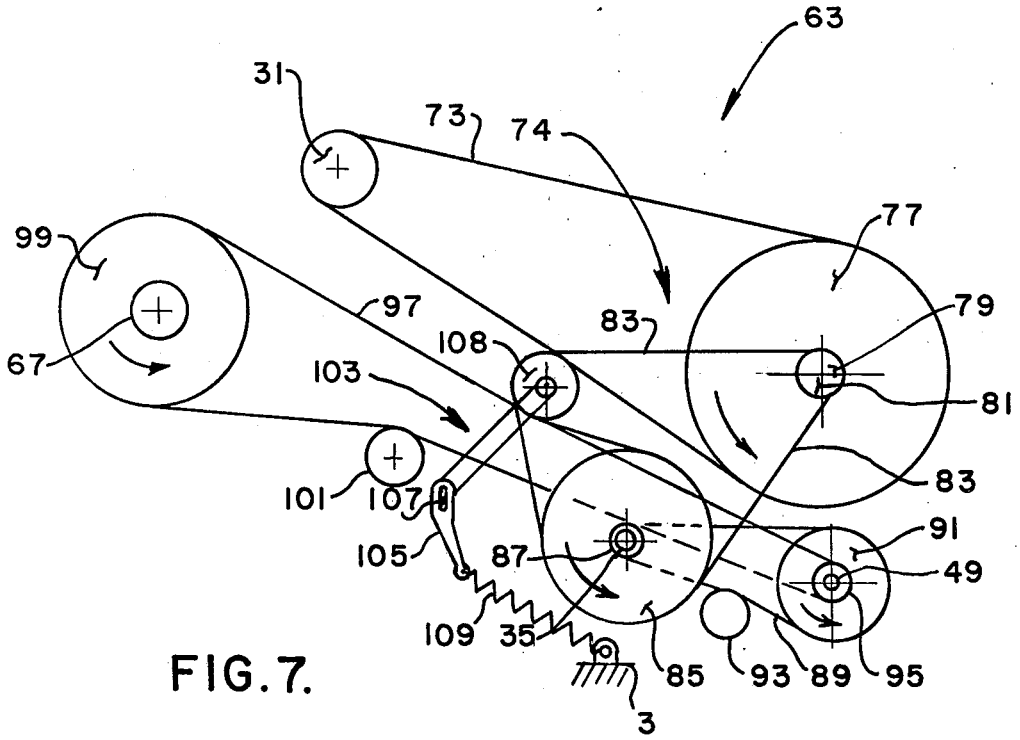
FIG. 7.

POWER BROOM WITH AUGER AND VACUUM DEBRIS CONVEYOR

BACKGROUND OF THE INVENTION

The present invention relates to power brooms, and more particularly to power brooms useful in removing gravel, dirt, dust, and other debris from flat roofs prior to recovering the roof with additional gravel and roofing sealant materials (e.g., asphalt).

In re-roofing buildings with flat, built-up roofs having a sealant (e.g., asphalt or the like) and an aggregate (e.g., gravel) covering the roof, it is highly desirable to remove all of the loose gravel and dirt thereby to insure that the new sealant material will properly seal with the prior roofing materials thereby to result in a watertight roof.

Traditionally, roofers had used hand brooms and shovels to clean the roof of loose gravel, dirt, and other debris prior to applying the new sealant materials. In recent years, power driven rotary brooms have been used to power sweep the roof. These power brooms did, in general, a better job dislodging loose gravel from the roof, but they created a considerable amount of airborne dust. Additionally, these prior power brooms required a considerable amount of hand labor to shovel the swept-up gravel and to remove the gravel from the roof.

To overcome the problems associated with prior art power brooms, vacuum dust and gravel collection systems were incorporated on prior power brooms. Typically, the power broom was enclosed within a housing or shroud so that only the lower portion of the rotating brush of the power broom contacted the roof and so that the swept-up dust and gravel would be contained within the shroud. A vacuum conveying system was connected to the shroud so as to vacuum convey the dust and gravel from the power broom as it moved across the roof. The vacuum conveying system generally consisted of a large vacuum source, such as a motor driven blower, mounted on a truck on the ground adjacent the building and connected to the power broom on the roof by means of a long, flexible hose. One such power vacuum broom is shown in U.S. Pat. No. 4,120,311.

However, while such prior art power vacuum brooms were quite effective in decreasing the amount of airborne dust, it was difficult for these prior art vacuum power brooms to entrain the dense gravel particles swept-up from the roof. Due to the high density of the gravel particles, very high air velocities within the shroud enclosing the power broom were required to be generated in order for the gravel particles to be entrained in the vacuum conveying airstream. If the vacuum source could not generate sufficiently high air velocities within the power broom shroud, gravel particles, particularly larger gravel particles, could accumulate within the power broom shroud thus requiring periodic and often shutdown of the power broom and manually cleaning certain areas with the broom enclosure.

Also, in prior art vacuum power brooms, very large clumps of dirt, gravel adhered to clumps of loosened asphalt, and other relatively large sized debris could be swept-up by the power broom, but would lodge in the vacuum conveying system thus blocking the flow of air through the vacuum system.

It will also be appreciated that in using a vacuum power broom on tall buildings or on buildings having a large roof, very long runs of hose (for example, 200–300 feet or more) were required to connect the power broom to the vacuum source located on the ground. Of course, these longer runs of hose resulted in an increased air flow friction within the hose which in turn reduced the air flow through the power broom and reduced the effectiveness of the broom in vacuum conveying the dense gravel particles. Also, these long runs of hose, when dragged across the roof, exerted a substantial force on the side of the power broom and made it difficult for the operator to accurately guide the power broom as it was propelled across the roof.

Also, in certain self-propelled power vacuum brooms, the drive wheels of the broom could be declutched or disengaged from the engine while the rotating brush was still being driven by the engine and while the brush was still in brushing or sweeping engagement with the roof. Thus, the rotating brush in contact with the roof resulted in a reaction driving force being applied to the power broom which tended to drive it in reverse direction. In certain instances, when the operator was standing next to the edge of the roof, this reverse driving action could dangerously push the operator backwards possibly causing him to fall from the roof, especially if the operator was not expecting the reverse propulsion force when he declutched the driving wheels.

Reference may be made to such prior U.S. patents as U.S. Pat. Nos. 485,577, 2,263,722, 3,676,886, 3,704,477 and 3,955,236 which disclose apparatus in the same general field as the present invention.

SUMMARY OF THE INVENTION

Among the several objects and features of this invention may be noted the provision of a vacuum power broom which positively conveys gravel and other dense debris from within the broom housing or enclosure to a vacuum source for the efficient entraining of the gravel and other dense debris in a vacuum conveyor;

The provision of such a power broom in which the rotating brush is positively lifted clear of the roof surface whenever the drive wheels of the power broom are uncoupled from the drive system thereby to prevent the unexpected forward or rearward propulsion of the power broom by engagement of the brush on the roof surface;

The provision of such a power broom which may be readily hoisted on and off a roof;

The provision of such a power broom in which the vacuum hose does not tend to cause the power broom to deviate from an intended line of travel as it moves across the roof;

The provision of such a power broom which does not require as powerful of a vacuum system as does prior art vacuum power brooms so as to carry away the swept-up debris;

The provision of such a power broom which can sweep up large chunks of dirt, gravel and asphalt clumps and the like and which can reduce these large chunks to a size suitable for vacuum conveying without clogging of the power broom;

The provision of such a power broom which may be operated for long periods of time without the necessity of cleaning out accumulated dense gravel or the like from within the brush enclosure; and The provision of such a power broom which is of rugged construction, which is reliable in operation, and which is relatively easy to use.

Other objects and features of the invention will be in part apparent and in part pointed out hereinafter.

Briefly stated, apparatus of the present invention for sweeping debris from a surface and for discharging the debris therefrom comprises a frame, a plurality of wheels secured to the frame for rollingly supporting the frame as the latter is moved across the surface to be swept. Further, the broom includes a horizontal brush mounted within the frame and extending generally transversely to the direction of travel of the apparatus as it moves along the surface to be swept. This brush is rotatable about a generally horizontal axis and is engageable with the surface for forcibly sweeping debris on the surface. A horizontal auger is mounted within the frame and the frame substantially encloses the brush and the auger so as to direct the debris swept-up by the brush to the auger. A discharge opening is provided within the housing for the debris at one end of the auger. The auger is rotatable about a horizontal axis for positively conveying the swept-up debris in one direction within the frame parallel to the axis of the auger toward the discharge opening.

BRIEF DESCRIPTION OF THE DRAWINGS

FIG. 4 is a horizontal sectional view taken along line 4—4 of FIG. 1 illustrating in plan view the portion of the frame housing the rotary brush, the auger, and the vacuum conveying system;

FIG. 5 is a top plan view of the apparatus shown in FIG. 1 with the engine removed for purposes of clarity;

FIG. 6 is a left side perspective view of the frame enclosure assembly of the power broom shown in FIGS. 1–5 with the wheels and engine removed;

FIG. 7 is a schematic diagram of the power drive system of the power broom taken on line 7—7 of FIG. 4 schematically illustrating the belt and pulley and chain and sprocket drive system for driving the rotary horizontal brush, the auger, and the drive wheels of the power broom.

Corresponding reference characters indicate corresponding parts throughout the several views of the drawings.

DESCRIPTION OF A PREFERRED EMBODIMENT

Figure 1:
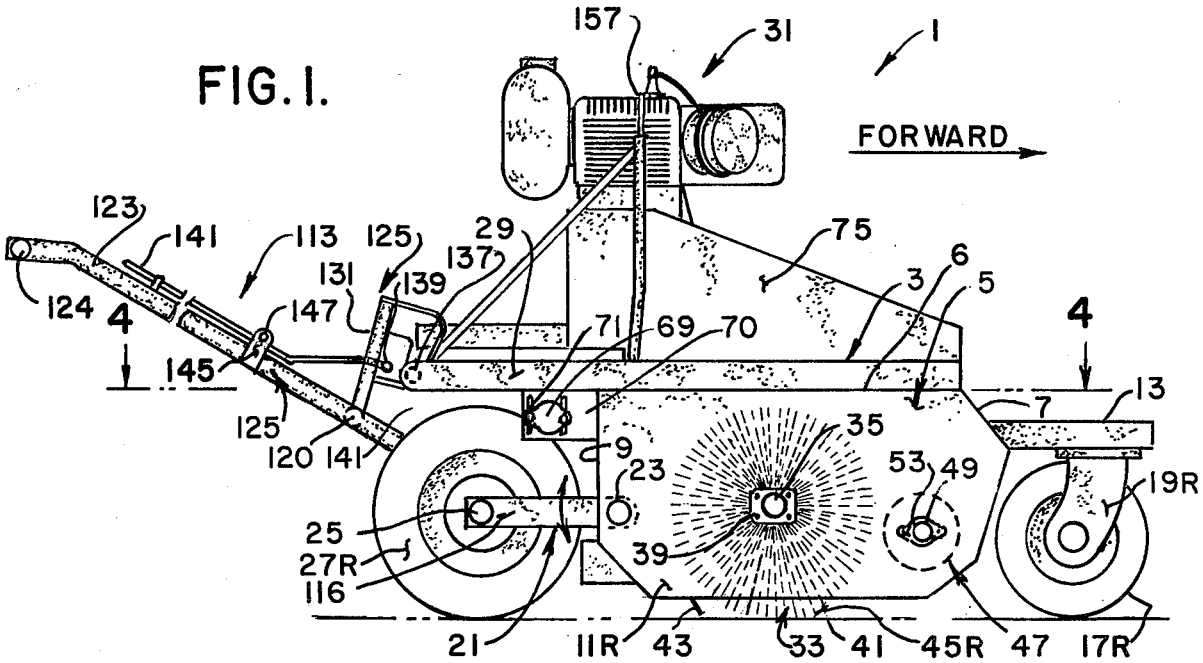
FIG. 1 is a side elevational view of a vacuum power broom of the present invention illustrated in its lowered operating position with its horizontal rotary brush in brushing engagement with a surface to be swept and with a drive system in driving engagement with the rear wheels of the power broom for driving the power broom in a forward direction of travel, as indicated by the arrow in FIG. 1.
Figure 2:
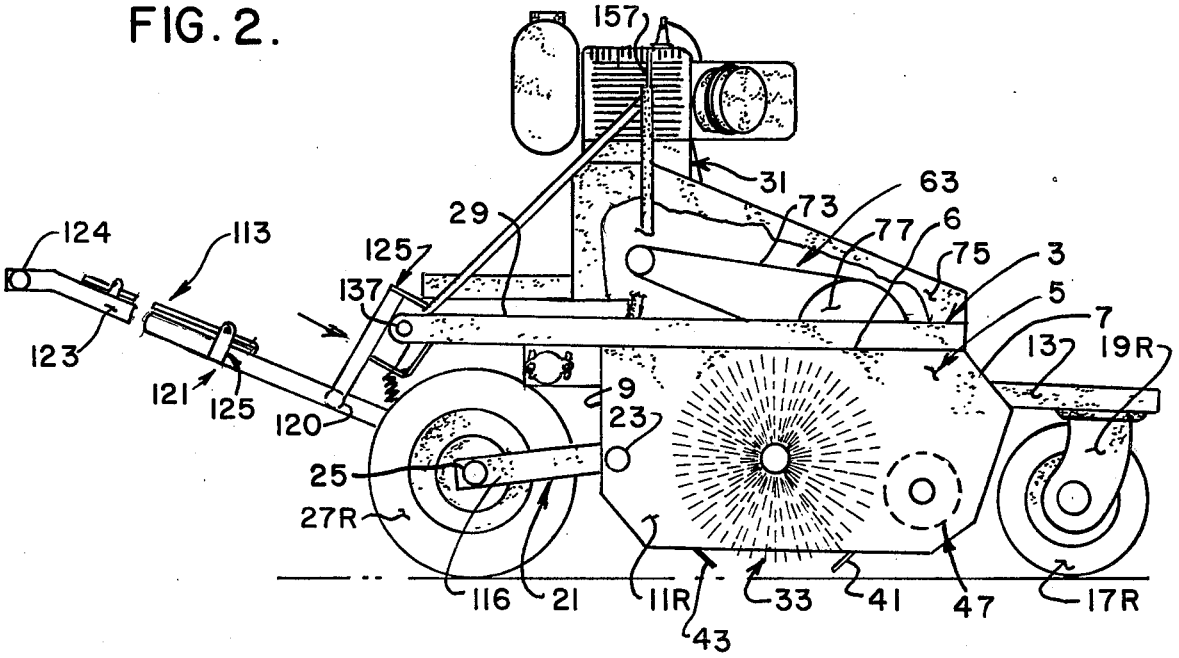
FIG. 2 is a view similar to FIG. 1 illustrating the power broom apparatus in its raised, retracted position with the rotary brush clear of the roof surface and with the driving means uncoupled from the rear wheels of the power broom.
Figure 3:
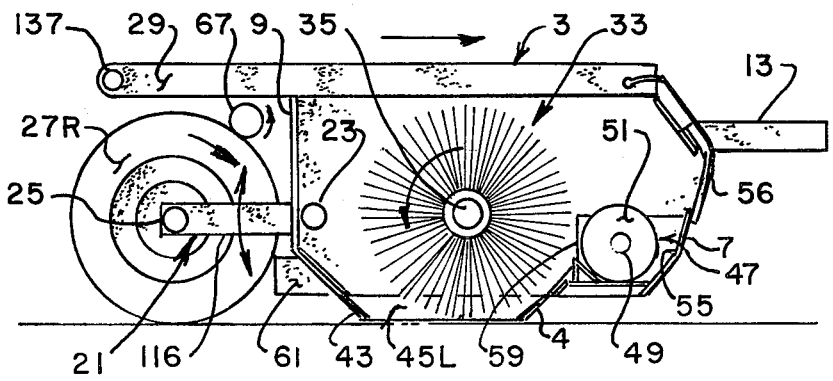
FIG. 3 is a partial side elevational view of the power broom in its lowered, operative position with the sides of the frame or brush enclosure removed illustrating the rotary brush and a transverse auger for positively conveying dense gravel particles and other debris transversely within the brush enclosure toward a vacuum inlet, the power broom being in its operative position.

Referring now to the drawings, and particularly to FIGS. 1–6, a power vacuum broom of the present invention is indicated in its entirety by reference character 1. The broom is shown to comprise a frame, as generally indicated at 3. The frame includes a housing or shroud, as indicated at 5, including a top 6, a front panel 7, a rear panel 9, and side panels 11R, 11L at the right and left sides of the shroud. As best shown in FIG. 3 and as will be explained in detail hereinafter, the front and rear panels of the shroud extend downwardly and inwardly toward the center of the shroud so as to substantially enclose the bottom of the shroud, but for a brush opening O (see FIG. 4) in the very bottom of shroud 5.

A front subframe, as indicated at 13, is rigidly affixed to and extends forwardly out from the top front portion of the shroud and includes a cross brace 15 (see FIG. 5) at the forward end of the subframe. A pair of front wheels 17R, 17L, are mounted in respective casters 19R, 19L which in turn are fastened to front subframe 13. The casters are free to rotate about a vertical axis thereby to facilitate guiding of the power broom as it travels along an intended line of travel, as indicated by the arrow in FIG. 1.

The power broom further includes a rear frame, as generally indicated at 21, which is pivotally connected to shroud 5 at a rear pivot connection 23 for pivoting or swinging about a horizontal transverse axis, as shown by the arrows in FIG. 1. A rear axle 25 extends between the rear frame members 21 at opposite sides of frame 3 and a pair of spaced apart rear wheels 27R, 27L are jounaled on axle 25. A rear frame extension 29 extends rearwardly from shroud 5 and is positioned generally above rear wheels 27R, 27L.

An internal combustion gasoline engine, as generally indicated at 31, such as a 12 horsepower, model K301 manufactured by the Kohler Company of Kohler, Wis., 53044 is mounted on an engine support frame 32 affixed to frame 3 at the rear right-hand corner thereof (see FIGS. 5 and 6). This engine or prime mover, through a drive system as will be hereinafter explained in detail, propels and otherwise drives various elements of power broom 1.

In accordance with this invention, a generally horizontal brush 33 is journaled within shroud 5 and extends between the right and left sides 11R, 11L for being power driven by engine 31 about a generally horizontal axis transverse to the direction of travel of the broom. It will be understood, however, that the rotary axis of brush 33 may be skewed relative to the direction of travel if so desired. The brush includes a central longitudinal brush shaft 35 with bristles 37 extending generally radially outwardly from the brush shaft. The construction of brush 33 may take any of a number of forms. For example, the bristles 37 may consist of relatively long, stiff bristles formed of a suitable synthetic resin material (e.g., polypropelene). Alternatively, bristles 37 may be made of relatively stiff spring wire or other metal. The exact construction of the brush may be varied, depending on the type of debris to be swept by the brush.

The side panels 11R, 11L of shroud 5 each carries a respective brush bearing, as indicated at 39, for journalling brush shaft 35. Each of these brush bearings is mounted relative to the sides of shroud 5 for selective adjustment in vertical direction by means of an adjustment screw 40 (see FIG. 6) thereby to permit the user to raise and lower the brush relative to frame 3 when the latter is in its lowered, operative position so as to provide the proper reaction force of the brush engaging the surface to the swept to insure a most effective cleaning of the roof surface.

A front skirt, as indicated at 41, is secured to the lower bottom portion of front panel 7 of shroud 5 so as to extend downwardly from the shroud in front of brush 33 and to form a sliding, sealing contact with the roof surface to be swept. This front skirt is preferably made of a suitable pliable, yet stiff material so that as the power broom moves across the roof surface, it may conform to and remain in sliding, sealing engagement with the roof as the front skirt encounters various obstacles or protrusions from the roof surface. Likewise, a rear skirt 43 is fixedly secured to rear panel 9 of the shroud behind the lower rear portion of brush 33 so as to slidingly, sealably engage the roof surface immediately behind the brush. Rear skirt 43 may be made of a resilient, pliable, yet stiff material similar to front skirt 41. Preferably, however, the rear skirt is more rigidly supported relative to rear shroud panel 9 than front skirt 41 by means of an angle-shaped backup plate 44 (see FIG. 6). This backup plate maintains the rear skirt in its desired operative position and substantially prevents the rear skirt from being bent away its position, as shown in FIG. 3. Likewise, each of the side panels 11R, 11L is provided with a respective side skirt 45R, 45L extending down from the bottom edges of the side panels of shroud 5 and enclosing the sides of the brush. Thus, the front, rear, and side skirts substantially sealingly engage the roof surface to be swept and seal brush 33 within shroud 5 thereby to substantially prevent airborne dust and solid, particulate debris from escaping from within the shroud as the brush is rotatably driven in brushing engagement with the roof surface. This not only prevents debris from flying through the air which may injure nearby workmen, but also serves to facilitate the containment of airborne dust.

Still further in accordance with this invention, a power driven, generally transverse auger, as generally indicated at 47, is mounted within shroud 5 forward of brush 33 and is positively driven in rotational direction about its longitudinal axis for conveying solid debris material (e.g., gravel particles, clumps of dirt, clumps of gravel imbedded in asphalt or other sealant material, rocks, and the like) in transverse direction to the shroud. Auger 47 comprises a longitudinal auger shaft 49 having generally helical auger flights 51 secured thereto and extending lengthwise along the auger shaft so that upon rotation of the auger shaft, the auger flights engage and move the particulate debris material in the direction of the pitch of the auger flights. The ends of auger shaft 49 are jounaled in suitable auger bearings 53 supported by side panels 11R and 11L.

Further in accordance with this invention, shroud 5 is preferably formed or constructed so that an auger trough, as indicated at 55, is provided therein in which auger 47 is disposed. Preferably, auger trough 55 is sized relative to the diameter of auger 47 such that approximately 1 inch (2.5 cm.) gap exist between the edges of auger flights 51 and the inner surfaces of the shroud forming the auger trough. Additionally, the auger trough is open at the top and front panel 7 of the shroud is so formed that gravel and other debris engaged by rotary brush 33 and propelled forwardly by the brush bounce off the forward upper surfaces of the shroud and fall downwardly into the auger trough. An auger door 56 extending transversely of shroud 5 is provided in front panel 7 of the shroud; this auger door being hinged at the top to permit access to the auger. It will be understood that auger door 56 is normally kept closed and suitable quick release clasps or fasteners may be utilized to hold the auger door closed. Additionally, suitable gaskets may be employed around the edges of the auger door relative to the shroud so as to seal the auger door when closed thereby to prevent the escape of excess airborne dust particles and the like.

Power broom 1 further includes a vacuum conveying chamber, as generally indicated at 57, incorporated within shroud 5 at the left-hand side of the shroud, as best shown in FIG. 4. At inlet opening 59 is provided in the sidewall of the shroud through which auger shaft 49 extends and into which the debris from auger trough 55 is positively conveyed by auger 47 as the latter is rotated. Vacuum conveying chamber 57 is shown in FIG. 4 to be generally elongate chamber extending rearwardly of the shroud and terminating in a hose fitting 61 located generally between rear drive wheels 27. A flexible vacuum hose (not shown) may fixedly and sealably connected to hose fitting 61 and may extend rearwardly of the power broom below the level of axle 25. It will appreciated that with the hose so connected to hose fitting 61 between the rear wheels, a considerable length of vacuum hose may be dragged along the roof by power broom 1 as the latter is propelled in its intended direction of travel without the weight of the vacuum hose causing the power broom to veer from its intended course of travel.

As generally indicated at 63, a drive system is provided at the left-hand side of frame 3 for interconnecting engine 31 to and for driving rear wheels 27, brush 33, and auger 47. This drive system is enclosed within a drive enclosure 65 at the left side of frame 3 thereby to protect personnel from the belts and pulleys and chains and sprockets of the drive system, as will be hereinafter disclosed. Generally, drive 63 includes a transverse rear drive shaft 67 extending transversely of frame 3 generally above rear wheels 27R, 27L and rotatably supportable by rear drive shaft bearing 69 carried by rear frame extensions 29. Bearings 69 are adjustably mounted on plates 70 carried by extensions 29 by bearing adjustment bolts 71 thereby to permit the rear drive shaft bearings together with the rear drive shaft to be adjusted in a generally vertical direction so as to insure that when the power broom 1 of the present invention is in its lowered operative position, drive shaft 67 positively, frictionally engages both of the rear wheels 27R, 27L so as to frictionally drive the rear wheels and to hence propel the power broom in generally forward direction.

As shown in FIG. 7, drive 63 further includes a V-belt and pulley drive 73 for transferring power from engine 31 to a chain and sprocket drive 74 located within drive enclosure 65 thereby to drive rear drive shaft 67, rotary brush 33, and auger 47. A guard 75 (see FIGS. 1 and 2) provided on top panel 6 of shroud 5 encloses the V-belt and pulley drive 73. The latter includes a V-belt pulley 77 journaled on a jack shaft 79 rotatably within drive enclosure 65. A sprocket 81 is affixed to jack shaft 79 and is rotatable with the pulley and the jack shaft. A first chain 83 extends rearwardly from sprocket 81 and is entrained around a brush sprocket 85 affixed to horizontal brush shaft 35. The brush shaft further has a drive sprocket 87 affixed thereto which in turn is in meshed with a chain 89 which is entrained around an auger sprocket 91 affixed to auger shaft 49. An idler sprocket 93 maintains tension on chain 89. Auger shaft 49 further has a drive sprocket 95 affixed thereto and a relatively long length chain 97 which extends rearwardly from sprocket 95 and is in mesh with a sprocket 99 affixed to and rotatable with rear drive shaft 67. An idler for tension sprocket 101 maintains tension on chain 97.

A bell crank tensioner, as generally indicated at 103, is provided for maintaining tension on chain 83. This tensioner is shown to include a bell crank 105 pivoted intermediate its ends about a pivot point 107 affixed to frame 3. The bell crank 105 carries a rotatable sprocket 108 on its outer end in mesh with chain 83. The end of the bell crank opposite idler sprocket 108 has a tension coil spring 109 affixed thereto with the spring being affixed to frame 3 thereby to maintain a biasing tension force on chain 83.

It will be understood that engine 31 may be equipped with a suitable centrifugal or manually operable clutch (not shown) thereby to facilitate starting of the engine and to selectively engage or disengage drive system 63. However, it will be noted that with the drive system 63 coupled to the engine and driven thereby, rear wheel drive shaft 67, brush shaft 35, and auger shaft 41 are all simultaneously driven at fixed speed ratios relative to one another as determined by the relative sizes of the drive and driven sprockets in the chain and sprocket drive assembly 74. As is best shown in FIG. 5, drive shaft 67 is provided with friction surfaces 111R, 111L engageable with rear tires 27R, 27L so that with the tires in engagement with the drive shaft 67, rotation of the drive shaft by the engine will frictionally drive the tires in such direction as to propel power broom 1 in forward direction.

As generally indicated 113, a handle assembly is operatively connected to frame 3 for permitting a workman to control the operation of power broom 1 and to guide the power broom as it is propelled forwardly along its intended direction of travel along the roof. Handle assembly 113 is best shown in FIG. 6 to comprise a cross shaft 115 journaled relative to side plates 11R, 11L of shroud 5 and being free to pivot about a transverse horizontal axis constituting the pivot connection 23 heretofore described. Outer rear frame members 116 are rigidly secured to and extend rearwardly from the outer ends of cross shaft 115. Intermediate rear frame members 117 are secured (e.g., welded) to and extend generally perpendicular from the cross shaft and are generally parallel to rear frame members 21. Axle 25 is carried by intermediate rear frame members 117 and rear wheels 27 (not shown in FIG. 6) are journaled on axle 25 between pairs of rear frame members 116 and 117. Thus, it will be understood that cross shaft 115 together with outer rear frame members 116 and intermediate rear frame members 117 constitute the rear frame assembly 21 which is free to pivot about horizontal axis 23 relative to frame 3 as a unit for purposes as will appear. Rigid handle members 118 extend upwardly and rearwardly from the outer ends of intermediate rear frame members 117 with the handle members being spaced apart from one another. Braces 119 located above respective handle members are rigidly secured to the handle members 118 and to the forward ends of the intermediate rear frame members 117 thereby to constitute a generally triangulated handle frame of substantial rigidity.

A transverse shaft 120 is rigidly secured to and extends between rigid handle members 118. A foldable handle section, as generally indicated 121, is pivotedly coupled to the lower rigid handle portion by means of sleeves 122 rotatably received on transverse shaft 120. The foldable handle assembly 121 includes a pair of spaced longitudinal handle members 123 extending rearwardly from sleeves 122 and having a transverse handlebar 124 secured to the rear ends thereof. As generally indicated 125, means is provided for locking the foldable handle assembly in a lowered, extended position (as shown in FIGS. 1, 2, and 4) in a normal operating position in which a workman may readily grasp handlebar 124 to control and steer the power broom and a raised folded position (not shown) in which the rear handle assembly 121 is rotated about cross shaft 120 to a generally vertical, upright, stowed position. With the handle in its upright, stowed position, the power broom may be readily transported in a manner as will appear.

As heretofore mentioned, and in accordance with the broader aspects of the present invention, power broom 1 may be selectively moved between a lowered operative position (as shown in FIGS. 1 and 3) in which the lower portion of rotary brush 33 is in brushing engagement with the roof surface and in which the upper portion of rear wheels 27R, 27L is in driving contact with rear wheel drive shaft 67, and a raised retracted position (as shown in FIG. 2) in which brush 33 is raised above and out of brushing engagement with the roof surface and in which rear drive shaft 67 is clear of and out of driving engagement with the rear wheels. Thus, in accordance with this invention, brush 33, even though continuously rotatably driven by engine 31, is raised clear of the roof surface when drive shaft 67 is moved clear of the drive wheels thereby terminating the forward propulsion of the power broom. It will be understood that, because of the direction of rotation of brush 33 (as shown by the arrow in FIG. 3), no propulsion force is exerted on power broom 1 by the brush remaining in contact with the roof surface when the rear drive wheels 27R, 27L are disengaged from the drive shaft. Thus, the operator of the power broom is not required to resist a rearward propulsion force of the power broom by the brush upon disengagement of the power drive.

Generally, power broom 1 is selectively moved between its raised retracted position and lowered operative position by the operator applying a downward manual force on handlebar 124 thereby to cause the rear frame assembly 21 to pivot on axle 25 thereby lifting frame 3 via rear frame members 116 and 117 secured to cross shaft 115. Thus, as the power broom is moved from its lowered, operative position (as shown in FIG. 1) to its raised retracted position, handlebar 124 is pushed downwardly thus raising pivot point 23 which in turn causes frame 3 to raise relative to the roof surface moving the lower portion of brush 33 clear of the roof and moving drive shaft 67 clear of rear drive wheels 27.

In accordance with this invention, as power broom 1 is moved from its lowered, operative position to its raised retracted position, means automatically is actuated for positively holding the power broom in its raised retracted position. This holding or locking means is generally indicated at 125 and comprises a sleeve 126 (see FIG. 5) rotatably fitted on cross shaft 120 between sleeves 122 secured to the lower ends of the foldable elongate handle members 124. An upright member 131 is secured to the middle portion of sleeve 129 and a locking member, as generally indicated at 133, is carried by the upright. Locking member 133 includes a D-shaped member 135. A transverse rigid shaft 137 extends between the upper rear frame extensions 29 above the level of rear wheels 27R, 27L with this transverse shaft 137 extending through the D-shaped member 135. Locking member 133 constitutes a lug secured to upright member 131 within the D-shaped member 135. With the power broom in its lowered operative position, shaft 137 is located within the D-shaped member below the top surface of and forward of lug 133. A tension coil spring 139 interposed between upright member 131 and the lower portion of the handle assembly biases locking means 127 forwardly for rotation of the locking member on sleeve 126 about transverse shaft 120. Thus, as the power broom is lifted from its lowered, operative position to its raised, retracted position, transverse shaft 137 slides along the front, generally vertical face of lug 133 and as the transverse shaft moves above the level of the lug, spring 139 rotates the locking means forwardly toward the front of the power broom whereby the upper face of lug 133 is disposed below transverse shaft 137 (see FIG. 8B). Upon the operator releasing downward force from handlebar 124, transverse shaft 137 is supported on the upper surface of lug 133 thus positively preventing the power broom from returning to its lowered operative position.

Figure 8A:
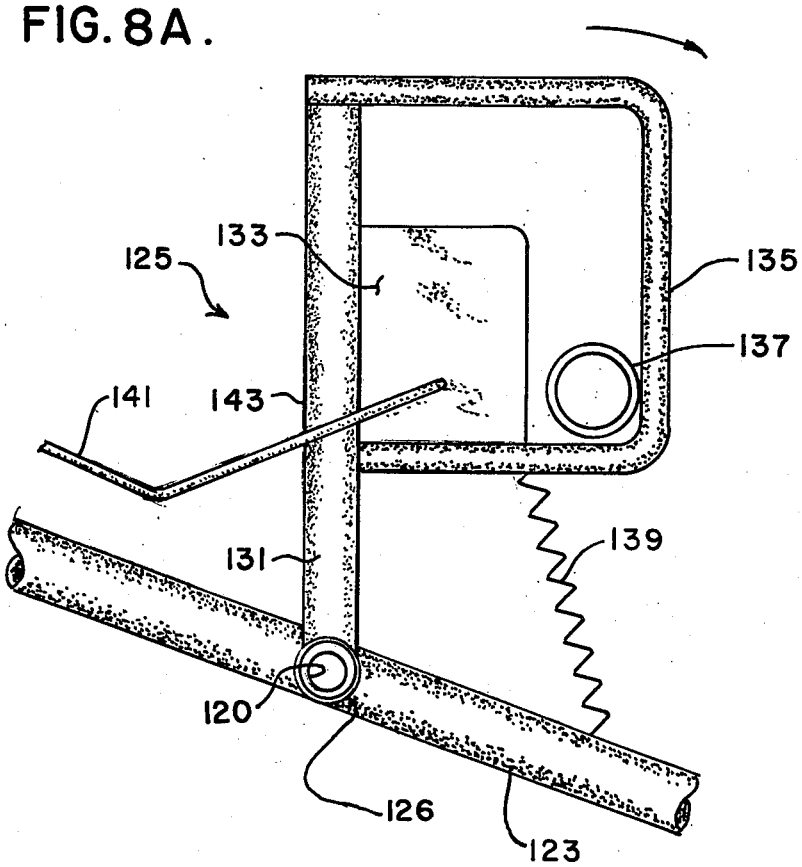
FIGS. 8A and 8B illustrate means incorporated in the handle of the power broom for raising and lowering the power broom between its lowered, operative position (FIG. 8A) and for maintaining the broom in its raised, retracted position (FIG. 8B).
Figure 8B:
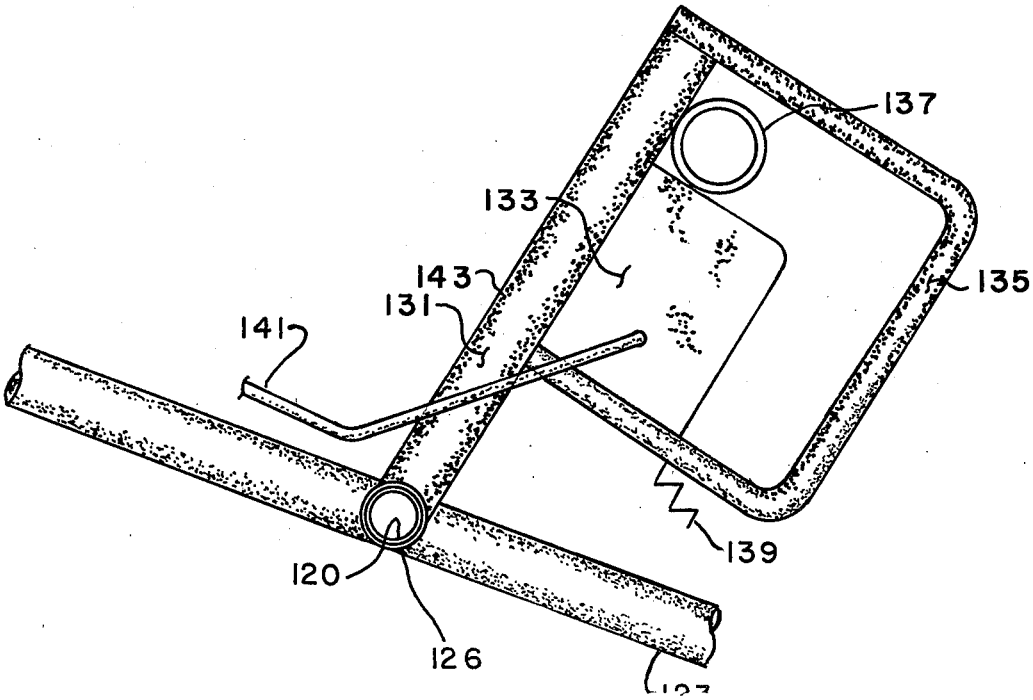

An axially movable release lever 141 is coupled to and extends rearwardly from lug 139 towards handlbars 123 for selective operation by the operator. When it is desired to move the power broom from its raised retracted position to its lowered operative position, the operator again applies a downward load on handlebars 123 thereby to slightly lift transverse shaft 137 from the upper face of lug 133 and then the operator pulls rearwardly on release lever 141 thus causing upright member 131 to rotate rearwardly (counterclockwise) on transverse shaft 120 from its position as shown in FIGS. 2 and 8B thereby permitting the operator to release downward force from the handlebars and permitting the transverse shaft to move below the level of the upper face of lug 133 so that shaft 67 again comes into operative frictional driving engagement with the upper portions of rear wheels 27R, 27L. Of course, simultaneously, brush 33 is lowered into brushing engagement with the roof.

As previously mentioned, the foldable handle assembly 121 is foldable from the operative position shown in FIGS. 1 and 2 to a raised folded position (not shown). A pair of spaced lugs 145 (see FIG. 5) is provided at the rear ends of rigid handle portions 118 and a transverse bar 147 extends laterally across the handle assembly between lugs 145 thereby to bear downwardly on the upper faces of handle members 118. A locking bar 149 is received in apertures provided in lugs 145 thereby to positively lock the handle in its lowered operative position. A matching set of lugs 151 is provided on transverse bar 137 for receiving lock bar 149 thereby positively holding the foldable handle portion 121 in its raised, folded position. Additionally, frame 3 is provided with a lift point 157 which enables the hook of a crane or the like to be inserted in the eye of the lift point to permit the ready hoisting of the power broom 1 on and off the roof of a building or the like.

In view of the above, it will be seen that the several objects and features of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

What is claimed is:

1. A power broom for removal of debris from a surface comprising a housing, a rotary brush mounted within said housing for rotation about a horizontal axis, said housing substantially enclosing said brush with the lower portion of said brush being exposed for brushing engagement with said surface, said brush being driven in such direction as to propel debris from said surface upwardly within said housing, the latter including a portion thereof adjacent said brush for receiving and collecting said debris picked up and propelled by said brush within said housing, an outlet for said debris within said housing, an auger positioned within said housing and extending generally transversely thereof for positively conveying said debris to said outlet, vacuum means in communication with said outlet for vacuum conveying said debris from said outlet, a plurality of wheels for rollingly supporting said power broom, means for driving said brush, said auger, and certain of said wheels, a handle connected to the rear of said housing and extending rearwardly therefrom, means operable in response to movement of said handle relative to said housing between first and second positions to cause said housing to be moved relative to said rear wheels and relative to said surface between an inoperative mode in which the rear wheels are not driven and in which said brush is lifted clear of said surface, an operative mode in which the rear wheels are driven in forward direction and in which said brush operatively engages said surface.

2. A power broom as set forth in claim 1 wherein said housing has flexible skirt means adjacent said surface thereby to sealingly engage said surface and to define an opening therewithin in which said brush operatively engages said surface with said skirt means substantially preventing the escape of debris from said housing.

3. A power broom for removal of debris from a surface comprising a housing, a rotary brush mounted within said housing for rotation about a horizontal axis, said housing substantially enclosing said brush with the lower portion of said brush being exposed for brushing engagement with said surface, said brush being driven in such direction as to propel debris from said surface upwardly within said housing, the latter including a portion thereof adjacent said brush for receiving and collecting said debris picked up and propelled by said brush within said housing, an outlet for said debris within said housing, an auger positioned within said housing and extending generally transversely thereof for positively conveying said debris to said outlet, vacuum means in communication with said outlet for vacuum conveying said debris from said outlet, said plurality of wheels including a pair of spaced rear wheels, said outlet extending rearwardly of said power broom between said rear wheels for connection to said vacuum means.

4. A power broom as set forth in claim 1 wherein said portion of said housing mounting said auger is substantially open from above thereby to permit relatively large sized debris to be readily conveyed by said auger to said outlet without clogging of the auger or said outlet.

5. A power broom as set forth in claim 1 wherein said handle is pivotal relative to said housing from an operating position in which it extends generally rearwardly of the power broom for being manually grasped by a workman and a folded, stowed position in which said handle permits the ready transport of said power broom.

6. A power broom as set forth in claim 1 wherein said drive means includes a prime mover, and a chain and sprocket drive for driving said rear wheels, said brush and said auger, said chain and sprocket drive including a transverse shaft journal supported by said housing at the rear thereof and being disposed for frictional engagement with said rear wheels when said power broom is in its operative position for frictionally driving said rear wheels and being clear of said rear wheels and when said power broom is in its raised retracted position.

7. A power operated broom comprising a frame, a brush mounted within said frame for rotation about a generally horizontal axis, a plurality of wheels for rollingly supporting said power operated broom on a surface, said wheels including a pair of spaced rear wheels, a rear wheel frame supporting said rear wheels and being pivotally connected to said frame for pivotal movement of said rear wheels relative to said frame about a generally horizontal axis, a drive shaft extending transversely of said frame for frictional engagement with said drive wheels, a power drive for said drive shaft and for said brush, and means for selectively raising and lowering said frame together with said drive shaft and said brush relative to said rear wheels and relative to said surface between a lowered operative position in which said drive shaft is in frictional driving engagement with said rear wheels and said brush is in operative engagement with said surface, thereby to drive said power broom forwardly, and a raised retracted position in which said drive shaft is clear of said rear drive wheels and in which said brush is clear of said surface.

8. Apparatus for sweeping particulate debris from a surface and for discharging the particulate debris therefrom, said apparatus including a frame, a plurality of wheels secured to said frame for rollingly supporting said frame as the latter is moved along the surface to be swept, a brush mounted within said frame for brushing said surface as said apparatus moves along said surface, said brush being rotatable about a generally horizontal axis and being engageable with said surface for foceably sweeping said particulate debris on said surface and for propelling said debris upwardly within said frame, said frame substantially enclosing said brush, a horizontal auger mounted within said frame, said frame substantially enclosing said brush and said auger so as to direct said particulate debris swept-up by said brush to said auger, a discharge opening for said particulate debris in said housing adjacent one end of said auger, said auger being rotatable about a generally horizontal axis for positively conveying said particulate debris in one direction parallel to the axis of said auger toward said discharge opening in said housing, power drive means for driving said brush, said auger, and drive wheels, and selectively operable means for moving said frame together with said brush relative to said surface and relative to said drive wheels from a raised retracted position in which said brush is clear of said surface and which said drive means is uncoupled from said drive wheels and an operative position in which said brush is in brushing engagement with said surface and in which said drive means is coupled to said drive wheels for propelling said apparatus along a desired line of travel.

* * * * *